US005860652A

United States Patent [19]

Ruff

[11] Patent Number: 5,860,652

[45] Date of Patent: Jan. 19, 1999

[54] EDUCATIONAL BOARD GAME

[76] Inventor: Stephen M. Ruff, 14890 Faversham Cir., Orlando, Fla. 32826

[21] Appl. No.: 725,847

[22] Filed: Oct. 4, 1996

Related U.S. Application Data

[60] Provisional application No. 60/008,005 Oct. 5, 1995.

[51] Int. Cl.[6] ..... A63F 3/00

[52] U.S. Cl. ..... 273/242; 273/430

[58] Field of Search ..... 273/242, 243, 273/248, 249, 240, 430

[56] References Cited

U.S. PATENT DOCUMENTS

| | | | |
|---|---|---|---|
| 1,635,734 | 7/1927 | Ziegler | 273/249 |
| 3,942,800 | 3/1976 | Holbrook | 273/254 X |
| 3,955,818 | 5/1976 | Hawke | 273/243 |
| 4,029,320 | 6/1977 | Hausman | 273/249 |
| 4,035,932 | 7/1977 | Massey | 273/249 |
| 4,121,823 | 10/1978 | McBride | 273/249 |
| 4,273,337 | 6/1981 | Carrera et al. | 273/243 |
| 4,372,559 | 2/1983 | Summers | 273/243 |
| 4,557,485 | 12/1985 | Lardon . | |
| 4,569,529 | 2/1986 | Gibbs | 273/274 |
| 4,625,970 | 12/1986 | Childs et al. | 273/257 |
| 4,817,959 | 4/1989 | Tinsley | 273/249 |
| 5,090,706 | 2/1992 | Hokanson . | |
| 5,120,066 | 6/1992 | Cohen | 273/258 |
| 5,139,268 | 8/1992 | Garnett . | |
| 5,215,309 | 6/1993 | Joel . | |
| 5,244,391 | 9/1993 | Bryant . | |
| 5,249,808 | 10/1993 | Batté . | |
| 5,259,623 | 11/1993 | Kanelos, Sr. . | |
| 5,299,808 | 4/1994 | Wood . | |
| 5,435,565 | 7/1995 | Benaderet . | |

*Primary Examiner*—William E. Stoll
*Attorney, Agent, or Firm*—Reising, Ethington, Learman & McCulloch, PLLC.

[57] ABSTRACT

An educational board game including a board having a series of spaces of varying colors and shapes, a plurality of game pieces, and a deck of cards including questions printed thereon. The game also includes a series of blank cards upon which questions can be written by a player or supervisor to be asked during game play. The game is played by rolling a die, moving a game piece a number of spaces designated by the die, drawing a card, answering a question on the card, and following the instructions on the card for movement of the game piece if the answer is correct. If desired, a player may be assisted to answer a question if a partially correct answer is given. Further, players can be required to identify the color and shape of the space on which their game piece has landed during play.

6 Claims, 2 Drawing Sheets

EDUCATIONAL BOARD GAME

This application is based on U.S. provisional application Ser. No. 60/008,055 filed Oct. 5, 1996.

FIELD OF THE INVENTION

This invention relates to an educational method and apparatus which also functions as a method and means of amusement. More particularly, the invention relates to a board game especially adapted for use by parents and children together to serve as a learning process for children in one or more selected topics.

BACKGROUND OF THE INVENTION

There are many board games in the prior art using apparatus comprising a board defining a pathway, a game piece for each player to advance along the pathway, a pair of dice and one or more sets of cards each containing information which is used in regard to advancing the game pieces along the pathway. Such prior art games are primarily if not exclusively amusement devices.

There is a need for a board game which is especially adapted for use by parents and children together which is not only fun to play but also performs a major function of teaching young children and testing their knowledge in matters which can be selected by parents as being important to the well-being of the children.

This invention is described with reference to a particular embodiment with certain optional modifications which may be used selectively as part of the game apparatus to provide for teaching appropriate subject matter.

BEST MODE FOR CARRYING OUT THE INVENTION

Figure 1:
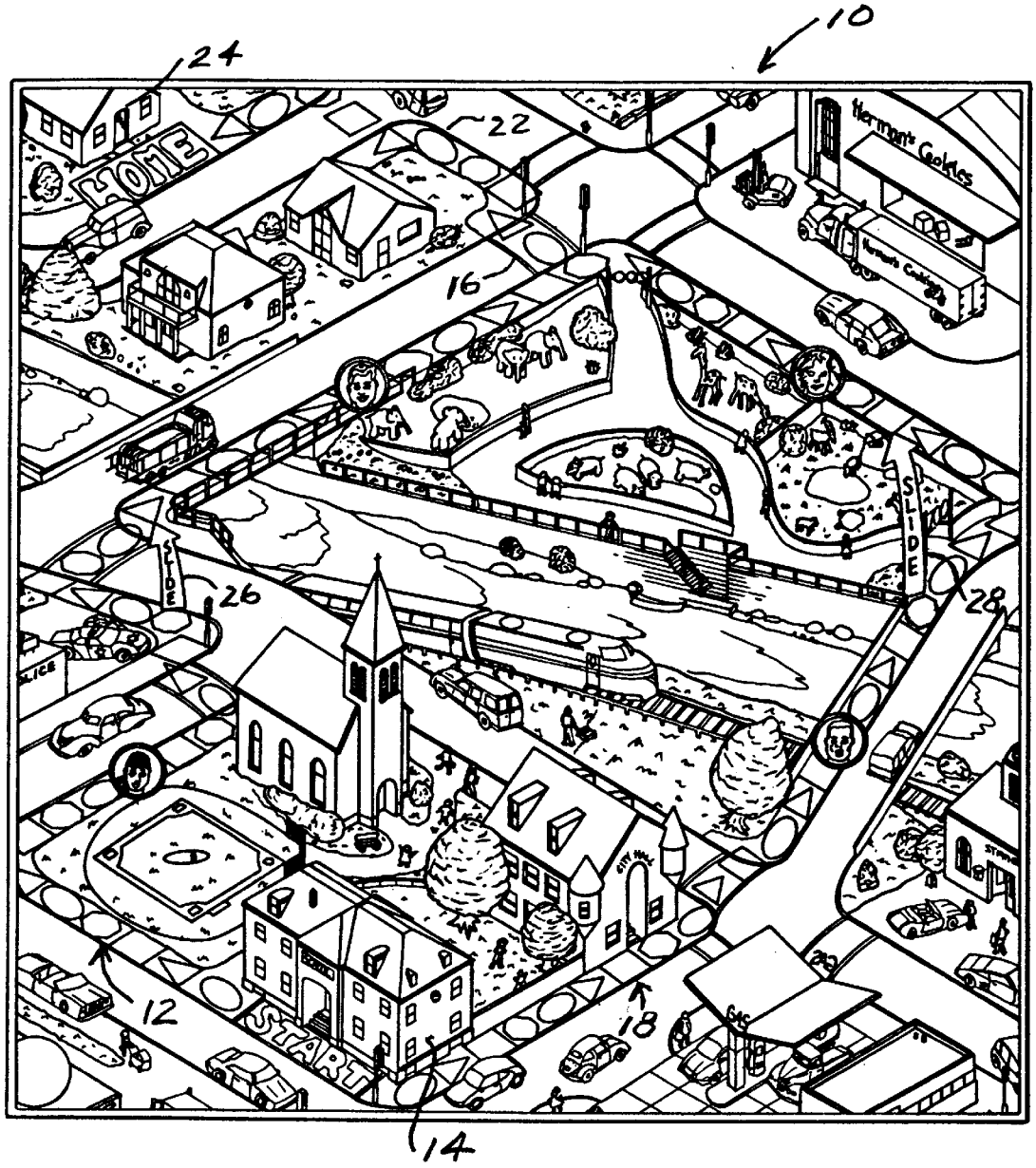
FIG. 1 is a plan view of the playing board of the invention.

FIG. 1 shows the game board 10 in plan view in colors which are actually used on the game board itself. The game board represents a perspective view of a portion of a village or other community with buildings, structures, vehicles and other apparatus of interest to small children. The game board comprises a pathway 12 which extends in a clockwise direction from a "Start" position at the corner of a school building 14 to a street crossing 16. In a similar manner, a pathway 18 extends from the "Start" position in a counter-clockwise direction to the street crossing 16. A pathway 22 extends from the street crossing 16 to the entrance of a house 24 which is labeled "Home Finish!".

Each pathway is depicted as a sidewalk or walkway. Each of the pathways comprises a series of discrete locations or "spaces". Each space is defined by a geometrical shape, namely, circles, squares, triangles and polygons. Each space is colored in accordance with its shape. In particular, the circles are yellow, the triangles are green, the squares are blue and polygons are red. There are also four spaces which each correspond to one of four "Guardian Characters" illustrated on the board.

Alternate routes 26, 28 and 30, each of which is labelled "Slide", are provided between selected spaces on the pathways.

Certain selected spaces on the pathways have a picture of a game character on the space. Although not shown in FIG. 1, a picture of a game character may be placed on several selected spaces.

Figure 2:
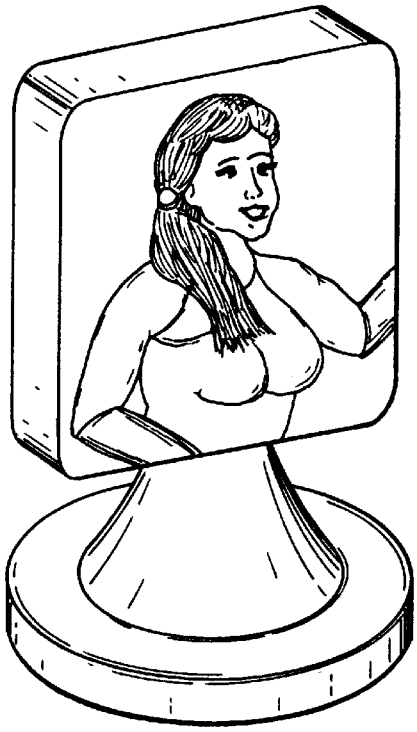
FIG. 2 shows a game piece.

A game piece is shown in FIG. 2 and is representative of a set of several game pieces, for example, four game pieces each bearing a picture of a different game character. Each game piece comprises a small pedestal which holds the picture of a game character.

A pair of dice, not shown, and is used in a conventional manner by each player in succession to obtain a number which determines the number of spaces the players game piece will advance on the pathway.

Figure 3:
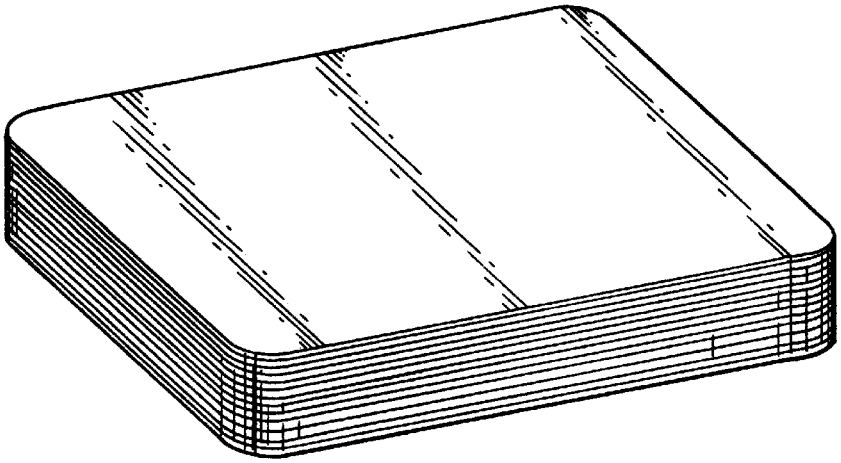
FIG. 3 shows a stack of game cards.

Four sets of game cards are provided. Each set of game cards corresponds in shape and color to one of the four different shapes of the spaces on the pathway. Thus, the circular cards correspond with the yellow circles on the pathway, the square cards correspond with the blue square spaces on the pathway, the triangular cards correspond with the green triangular pathway and the polygonal cards correspond with the red polygons on the pathway. The set of square game cards is depicted in a stacked arrangement in FIG. 3.

Each of the game cards has a question and an instruction printed on its bottom face. The question may relate to any desired subject of learning such as health, safety, numbers, letters, etc. The instruction tells the player who draws the card how many spaces to move the game piece. Table A below shows typical questions and instructions which are used on the game cards.

TABLE A

| | | |
|---|---|---|
| What letter is this and what sound does it make? | How many sides does a triangle have? | What letter is this and what sound does it make? |
| p | | R |
| Move forward 1 space. | Move forward 3 spaces. | Move forward 1 space |
| What letter is this and what sound does it make? | Are all four sides of a rectangle the same size? | What letter is this and what sound does it make? (two sounds) |
| M | | A |
| Move forward 1 space. | Move forward 3 spaces | Move forward 2 spaces. |
| How many sides does a square have? | What letter is this and what sound does it make? | Are the sides of a square the same size? |
| | B | |
| Move forward 3 spaces. | Move forward 1 space. | Move forward 3 spaces. |
| What letter is this and what sound does it make? (two sounds) | What letter is this and what sound does it make? | What letter is this and what sound does it make? |
| E | K | H |
| Move forward 2 spaces. | Move forward 1 space. | Move forward 1 space. |
| What letter is this and what | What letter is this and what | What letter is this and what |

TABLE A-continued

| | | |
|---|---|---|
| sound does it make? (two sounds) | sound does it make? | sound does it make? |
| G<br>Move forward 2 spaces. What letter is this and what sound does it make? (two sounds) | J<br>Move forward 1 space. What letter is this and what sound does it make? | Z<br>Move forward 1 space. What letter is this and what sound does it make? |
| C<br>Move forward 2 spaces. What letter is this and what sound does it make? (two sounds) | N<br>Move forward 1 space. What letter is this and what sound does it make? | L<br>Move forward 1 space. What letter is this and what sound does it make? |
| O<br>Move forward 2 spaces. What letter is this and what sound does it make? | D<br>Move forward 1 space. What letter is this and what sound does it make? | Q<br>Move forward 2 spaces. What letter is this and what sound does it make? (two sounds) |
| V<br>Move forward 1 space. What letter is this and what sound does it make? | F<br>Move forward 1 space. What letter is this and what sound does it make? | I<br>Move forward 2 spaces. What letter is this and what sound does it make? |
| X<br>Move forward 2 spaces. What letter is this and what sound does it make? (two sounds) | T<br>Move forward 1 space. What letter is this and what sound does it make? | S<br>Move forward 1 space. What letter is this and what sound does it make? (three sounds) ya, e, i) |
| U<br>Move forward 2 spaces. If you see a dog running around outside and it looks like a friendly dog what do you do? Why? | W<br>Move forward 1 space. What is an electrical outlet? | Y<br>Move forward 3 spaces If you see a dog with his owner, what do you do before you pet the dog? Why? |
| Move forward 2 spaces. If you have a toy that will fit into an electrical outlet, should you put it in? | Move forward 1 space Can you play with an electrical outlet? Why? | Move forward 1 space. If your parents are inside, the kids are outside playing ball and the ball goes in the pool, What do you do? |
| Move forward 2 spaces When you get into a car or truck, what do you do? Why | Move forward 3 spaces. If someone asks you to try drugs of type, what do you say? Why? | Move forward 3 spaces Never take any medicine even if it's your own, unless your parents give it to you. Why? |
| Move forward 1 space. Do you play with or open cleaning bottles? Why? | Move forward 4 spaces. If someone says to try a cigarette, what do you say? Why? | Move forward 2 spaces. If someone asks you to try a drink of beer or alcohol, what do you do? |
| Move forward 2 spaces. Never play with lighters or matches. Why? | Move forward 3 spaces. If a stranger asks you to come with him, what do you say? Why? | Move forward 4 spaces. If a stranger offers you a gift like candy, what do you say? Why? |
| Move forward 2 spaces. If you see a group of ants on the ground, what should you do? | Move forward 4 spaces. Never play with the stove in the kitchen because _____ ____. | Move forward 3 spaces. Never go into a pool if no adult is watching you because ____ _____. |
| Move forward 2 spaces. If you see a group of bees, what should you do? | Move forward 2 spaces. While playing outside, you should always wear your shoes. Why? | Move forward 3 spaces. If someone touches your private parts, what do you do? |
| Move forward 2 spaces. If there is a fire in the building you are in, what do you do? | Move forward 1 space. If something is cooking, you should never touch it because __ _____. | Move forward 4 spaces. If you are crossing a street, after receiving your parent's permission, what do you do? |
| Move forward 3 spaces. If there is a full pot in the kitchen, why shouldn't you touch it? | Move forward 1 space. Never take rides from strangers Why? | Move forward 3 spaces. After going Trick or Treating on Halloween, do not eat anything until when? |
| Move forward 1 space. Never play with a real gun because _____ | Move forward 4 spaces. Why should you never play with sharp objects or run around with things like scissors or knives. | Move forward 1 space. You should never have an electrical appliance near a bathtub, shower, or pool. True or false? |
| Move forward 4 spaces. If a friend tells you to do something that you know your parents would not want you to do, what do you do? | Move forward 2 spaces. Taking something that is not yours is bad. Why? | Move forward 3 spaces. If a lady looks nice and asks you to help find her kitty, what do you do? |
| Move forward 1 space. When your teacher gives you homework, is it important to | Move forward 2 spaces. If a man looks nice and asks you to help find his puppy, what | Move forward 3 spaces. Why is it important to read books or to have books read to |

TABLE A-continued

| | | |
|---|---|---|
| finish? | do you do? | you? |
| Move forward 2 spaces. | Move forward 3 spaces. | Move forward 1 space. |
| Always walk home from school or a friend's house the same way. | Do you know your address? | Do you know your phone number? |
| Why? | | |
| Move forward 3 spaces. | Move forward 3 spaces. | Move forward 2 spaces. |
| Do you know your last name? | You should brush your teeth after every meal. | If food falls on the ground, you should not eat it. |
| | Why? | Why? |
| Move forward 1 space. | Move forward 1 space. | Move forward 1 space. |
| Is it good to always chew your food very well? | Exercising is healthy and good for you. True or false? | You should never adjust the water temperature before stepping into a tub or shower? |
| Why? | | True or false? |
| Move forward 1 space. | Move forward 1 space. | Move forward 1 space. |
| You should wear light colored or reflective clothing when riding your bike in the dark | Throwing balls in the house is okay if it is on the weekend. | If you are on your bike, skates, or skateboard, it's okay for a vehicle to pull you. |
| True or false? | True or false? | True or false? |
| Move forward 2 spaces. | Move forward 1 space. | Move forward 1 space. |
| When a street light is green you should still look both ways before crossing | Do not distract the driver of a car or bus by talking too loudly or being too active | You can ride your bike across the street. |
| True or false? | True or false? | True or false? |
| Move forward 2 spaces. | Move forward 2 spaces. | Move forward 3 spaces. |
| You should be allowed to go off by yourself, if you feel it's safe | Crossing in the middle of the street is okay. | It is important to go to the dentist to have your teeth checked. |
| True or false? | | |
| | True or false? | True or false |
| Move forward 3 spaces. | Move forward 2 spaces | Move forward 1 space. |
| You are a stupid child. | Running across the street is okay if no cars are commg | If an emergency happens in your home, what number do you call to have the police or fire department come by? |
| True or false? | | |
| | True or false? | |
| Move forward 3 spaces. | Move forward 2 spaces. | Move forward 3 spaces. |
| You should believe in yourself no matter what other people say. | If someone is hurting you, tell your teacher or parents. | When you walk down the street, always walk facing traffic. |
| True or false.? | True or false? | True or false? |
| Move forward 2 spaces. | Move forward 3 spaces. | Move forward 3 spaces. |
| If someone touches you in a way that you don't want to be touched, even if it is an adult can you say no? | Never put a plastic bag over your head or the head of anyone else? | Surprise!!! |
| Why? | | Free move!!! |
| | True or false? | |
| Move forward 3 spaces. | Move forward 3 spaces. | Move forward one space. |
| Is it bad to join gangs? | Surprise!!! | If someone is hurting you, you always have the right to say no even to an adult. |
| Why? | | True or false? |
| | Free Move!!! | |
| Move forward 3 spaces. | Move forward one space. | Move forward 3 spaces. |
| If someone you don't know says "someone is hurt, come with me." What do you do? | Staying in school is important. | Is it good to be active in sports? |
| | True or false? | |
| Move forward 3 spaces. | Move forward 3 spaces. | Move forward 2 spaces. |
| If a police officer comes to the door and you are home alone, do you let him in? | Why should you make sure that water is turned all the way off and not dripping? | Why should you always turn the lights off when you leave the room? |
| Move forward 3 spaces. | Move forward 2 spaces. | Move forward 2 spaces. |
| If you want to ask for something, you should always say _____. | Surprise!!! | If someone else is talking, and you want to say something, what do you do? |
| | Free move!!! | |
| Move forward 2 spaces. | Move forward one space | Move forward 3 spaces. |
| Is it okay to talk when you are eating? | If it okay to talk loudly when you are at the movies? | It's not good to make fun of someone who is different from you because _____ . |
| Move forward 1 space. | Move forward 2 spaces. | Move forward 3 spaces. |
| If you unwrap a piece of candy or something else, what should you do with the wrapper? | To have good posture, it is best to put most of your weight on one foot. | You should smile as often as you can. |
| | True or false? | True or false? |
| Move forward 1 space. | Move forward 1 space. | Move forward 3 spaces. |
| It is not good to scream or throw a fit in a public place. | If you are sitting in a full room, and an elderly person walks in, you should get up and let them sit. | Surprise!!! |
| Why? | True or false. | Free move!!! |

TABLE A-continued

| | | |
|---|---|---|
| Move forward 3 spaces.<br>If someone calls you names or makes fun of you, what should you say? | Move forward 3 spaces.<br>When is a good time to kick, yell and scream? | Move forward one space.<br>When a relative is leaving your house and everyone is kissing them do you have to kiss them too? |
| Move forward 2 spaces.<br>You should always say excuse me as loud as you burp.<br>True or false. | Move forward one space.<br>If someone is asking you if you want something, and your parents say it is okay you should always say "Yes, _____ or no _____." | Move forward 2 spaces.<br>What part of your arm stays off the table when you eat? |
| Move forward 2 spaces.<br>Standing up straight looks better than hunching over.<br>True or false? | Move forward 3 spaces.<br>Is it important to keep your room clean?<br>Why? | Move forward 2 spaces.<br>If you are getting into an elevator and other people are getting out, you should try to get in while they are getting out.<br>True or false? |
| Move forward 1 space.<br>When your posture is good, your head will line up with your feet.<br>True or false? | Move forward 3 spaces.<br>If you need to get by someone that is in your way, you politely say _____. | Move forward 2 spaces.<br>After eating, you should always push your _____ in. |
| Move forward 2 spaces.<br>I'll treat other people as I'd like them to treat _____. | Move forward 1 space.<br>If you need help form someone, get their attention by saying _____. | Move forward 1 space.<br>Is it okay to say bad things about people behind their backs.<br>True or false. |
| Move forward 2 spaces.<br>You should always sit all the way back in your chair.<br>True or false? | Move forward 2 spaces.<br>You should love yourself.<br>True or false? | Move forward 3 spaces.<br>After you play, always clean up your _____. |
| Move forward 1 space. | Move forward 3 spaces. | Move forward 1 space. |

The rules of the game are as follows. First, each player picks a game piece character & starts at the space on the board marked "School." Each player will then roll the die, and the person with the highest number will go first. The remaining players will take their turns clockwise based upon where they are seated about the board. For the first turn, each player rolls the die and then chooses which of the two paths on the board to take. The player then moves the designated amount of spaces on the board.

After the player rolls the die and moves the indicated amount of spaces, he must then name the shape and color of the space landed on. The player then picks a card corresponding to that shape and color and hands it to the parent or another player to read. Each card contains the answer as well as the question, and parents should read the card aloud to their child and have their child answer the question.

If the answer is correct, the player will move ahead the amount of spaces designated on the card. If the answer is partially right, the child should be worked with to bring their answer to a correct response and have them still move ahead the designated amount of spaces. If the answer is incorrect, the correct answer should be explained to the child and they should remain at the same spot on the board until their next roll of the die. If the question is a true/false question and is answered correctly, the child should explain why it was true or false. After finishing with the card, the player should place it at the bottom of the pile and allow the next player to take their turn.

If a player lands on a space that is occupied, the player must move back one space or, if that is occupied, to the next available space and select a card corresponding to the available space. If the player answers the question correctly but the card instructs them to move forward a number of spaces which would land them back on the occupied space, the player may not move their piece forward. There should never be more than one character on any space.

If a player lands on a slide, they can slide on to the designated spot but in order to advance they must answer the question correctly. If a player lands on a slide after moving up for getting a question correct, they must answer that question also. If they answer correctly, they slide and move forward however many spaces are stated on that card. For example, if a player is one space away from a slide, answers a question correctly, and is instructed by the card to move forward one space, the player moves forward to the slide and answers another question. This is the only time a player will answer two questions consecutively. If the second card says move forward 2 spaces and the player answers incorrectly, they do not move their piece forward. If they answer correctly, they slide and move forward 2 spaces.

If a player lands on a space with one of the Guardian Characters on it, they do not have to pick a card and answer a question. They roll the die again and move the corresponding number of spaces. For example, if a player is three spots away from the character "Destiny" and rolls a 2, they move 2 spaces and answer the question. If they answer correctly and the card instructs them to move ahead one space, they will land on the "Destiny" space. The player will roll the die again and move forward the number of spaces on the die without having to answer a question.

When a player reaches close to home they must roll the exact number needed to reach home. For example, if they are three spaces away from home and roll a six, they cannot move and it is the next players turn. If they roll a one or two they move up and answer the question. If they roll a three they make it home safely and are declared the winner. However, all players and parents are winners since the knowledge and safety tips they learn will be with them forever.

If parents disagree with any of the questions or answers on the cards, they should remove any cards they disagree with or change the answers as they think appropriate. The game also includes blank cards for parents to write any questions that are not included in the game that they will feel will benefit their children.

Although this invention has been described with reference to a particular embodiment, it will be understood that it may be used in a variety of different embodiments with equivalent forms of the game apparatus and rules of play.

What is claimed is:

1. A method of playing a game of the type including a board having a series of spaces, at least one game piece, a collection of cards having questions thereon, and at least one blank card, said method including the steps of:

writing a question on the blank card that is desired to be asked during game play and adding the card to the collection of cards;

moving the game piece a number of spaces on the board;

drawing a card from the collection of cards;

reading a question from the card that was drawn; and answering the question from the card that was drawn.

2. The method of claim 1 wherein the game is played by a plurality of participants, said method further including the step of having one of the participants write the question on the blank card.

3. The method of claim 1 wherein each card includes instructions for moving the game piece, said method further including the step of moving the game piece in accordance with the instructions on the card that was drawn if the answer to the question on the card is correct.

4. The method of claim 1 wherein the board includes a starting space, an ending space, and multiple paths therebetween, said method further including the step of selecting a path to use for travelling from the starting space to the ending space.

5. The method of claim 1 wherein the board includes at least one slide path joining a space on the board at the beginning of the slide path with a non-adjacent space at the end of the slide path, said method further including the steps of:

if the game piece is moved to the space at the beginning of the slide path, drawing a card after moving the game piece, reading a question on the card, and receiving an answer to the question on the card; and in response to a correct answer, moving the game piece to the end of the slide path.

6. The method of claim 1 wherein the board includes at least one space having a character associated therewith; said method further including the step of:

if the game piece is moved to the space having the character associated therewith, moving the game piece again without requiring that a question be answered.

* * * * *